US012392128B2

(12) United States Patent
Balinbin

(10) Patent No.: US 12,392,128 B2
(45) Date of Patent: Aug. 19, 2025

(54) SYSTEMS AND METHODS FOR A DWELLING LAYOUT

(71) Applicant: SAGE PEGASUS IP HOLDINGS LLC, Denver, CO (US)

(72) Inventor: William M. Balinbin, Denver, CO (US)

(73) Assignee: SAGE PEGASUS IP HOLDINGS LLC, Denver, CO (US)

( * ) Notice: Subject to any disclaimer, the term of this patent is extended or adjusted under 35 U.S.C. 154(b) by 140 days.

(21) Appl. No.: 17/861,127

(22) Filed: Jul. 8, 2022

(65) Prior Publication Data

US 2023/0027944 A1 Jan. 26, 2023

Related U.S. Application Data

(60) Provisional application No. 63/221,412, filed on Jul. 13, 2021.

(51) Int. Cl.

| | |
|---|---|
| ***E04B 1/348*** | (2006.01) |
| ***E04H 1/02*** | (2006.01) |
| ***E04H 3/02*** | (2006.01) |

(52) U.S. Cl.

CPC ..... *E04B 1/34869* (2013.01); *E04H 1/02* (2013.01); *E04H 3/02* (2013.01)

(58) Field of Classification Search

CPC ..... E04B 1/34869; E04H 1/02; E04H 3/02; E04H 1/005; B63B 29/02; A47C 17/86; A47C 19/22

See application file for complete search history.

(56) References Cited

U.S. PATENT DOCUMENTS

| | | | | |
|---|---|---|---|---|
| 3,775,919 | A * | 12/1973 | Fulton | E04B 1/34846 D25/4 |
| 10,231,553 | B1 * | 3/2019 | Gregory | A47C 19/025 |
| 2003/0070224 | A1 * | 4/2003 | Walsh | A47C 19/22 5/2.1 |
| 2010/0269254 | A1 * | 10/2010 | Sanders, Jr. | A47C 19/20 5/174 |
| 2015/0052832 | A1 * | 2/2015 | McLoughlin | E04H 3/02 5/2.1 |
| 2015/0247338 | A1 * | 9/2015 | Woodroffe | E04B 1/35 52/64 |
| 2016/0376784 | A1 * | 12/2016 | Timur | E04B 1/343 52/27 |
| 2018/0291615 | A1 * | 10/2018 | Baker | E04B 1/34869 |

* cited by examiner

*Primary Examiner* — Gisele D Ford

(74) *Attorney, Agent, or Firm* — HOLLAND & HART LLP

(57) ABSTRACT

A dwelling including at least four walls defining a housing unit and an area of the housing unit. The housing unit includes at least one interior wall, a full-sized kitchen, a first closet positioned, and a raised bed unit. At least one of the at least four walls and the at least one interior wall define a bathroom. The full-sized kitchen is positioned along at least one of the four walls. The first closet is positioned a distance from the four walls and the interior wall. The raised bed unit includes a raised platform and a first bed positioned on the raised platform. The raised platform defines a storage area beneath the first bed. The first closet is positioned at least partially within the storage area, and the area of the housing unit is less than 400 square feet.

19 Claims, 10 Drawing Sheets

SYSTEMS AND METHODS FOR A DWELLING LAYOUT

CROSS REFERENCE TO RELATED APPLICATIONS

This application claims priority to and the benefit of U.S. Provisional Patent Application No. 63/221,412, entitled "SYSTEMS AND METHODS FOR A DWELLING LAYOUT," filed Jul. 13, 2021, the disclosure of which is hereby incorporated by reference in its entirety.

TECHNICAL FIELD

The present disclosure relates generally to dwelling layouts, and more particularly to layouts of apartments, hotel rooms, and extended stay hotel rooms.

BACKGROUND

Real estate prices continue to rise, increasing living costs for households, increasing costs for builders and contractors, increasing costs for landlords, and reducing profits for builders, contractors, and landlords. To compensate for these increased costs, builders, contractors, and landlords have been building smaller dwellings to increase the number of dwellings per unit area, increasing the number of dwellings sold or rented per unit area. At least some of these dwellings include multiple housing units within the dwelling (apartments, hotels, condominiums, extended stay hotels, etc.). Reducing the area of these housing units reduces the overall space for amenities within the housing unit that a household needs to function. In some cases, the housing units are constructed without needed amenities. There exists a need for a small housing unit that is self-contained, or that includes all that is needed for a household to function.

SUMMARY

One aspect of the present disclosure is directed to a dwelling including at least four walls defining a housing unit and an area of the housing unit. The housing unit includes at least one interior wall, a full-sized kitchen, a first closet, and a raised bed unit. At least one of the at least four walls and the at least one interior wall define a bathroom. The full-sized kitchen is positioned along at least one of the four walls. The first closet is positioned a distance from the four walls and the interior wall. The raised bed unit includes a raised platform and a first bed positioned on the raised platform. The raised platform defines a storage area beneath the first bed. The first closet is positioned at least partially within the storage area, and the area of the housing unit is less than 400 square feet.

Another aspect of the present disclosure relates to a method of furnishing a housing unit. The housing unit is defined by at least four walls that define an area of the housing unit. The method includes installing at least one interior wall. At least one of the at least four walls and the at least one interior wall define a bathroom. The method also includes installing a full kitchen positioned along at least one of the at least four walls. The method further includes assembling a raised bed unit positioned along the at least one interior wall and at least one of the at least one four walls. The raised bed unit defines a closet positioned beneath the raised bed unit, and the area of the housing unit is less than 400 square feet.

Yet another aspect of the present disclosure relates to a dwelling including at least four walls defining a housing unit defining an area of the housing unit. The housing unit includes a full-sized kitchen, a raised bed unit, a first closet, a second closet, and a desk. The full-sized kitchen is positioned along at least one the four walls. The raised bed unit includes a raised platform and a bed positioned on the raised platform unit. The raised platform unit defines a storage area beneath the bed. The first closet is positioned at least partially within the storage area. The second closet is positioned at least partially within the storage area. The desk is positioned at least partially within the storage area, and the area of the housing unit is less than 400 square feet.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label.

Figure 1:
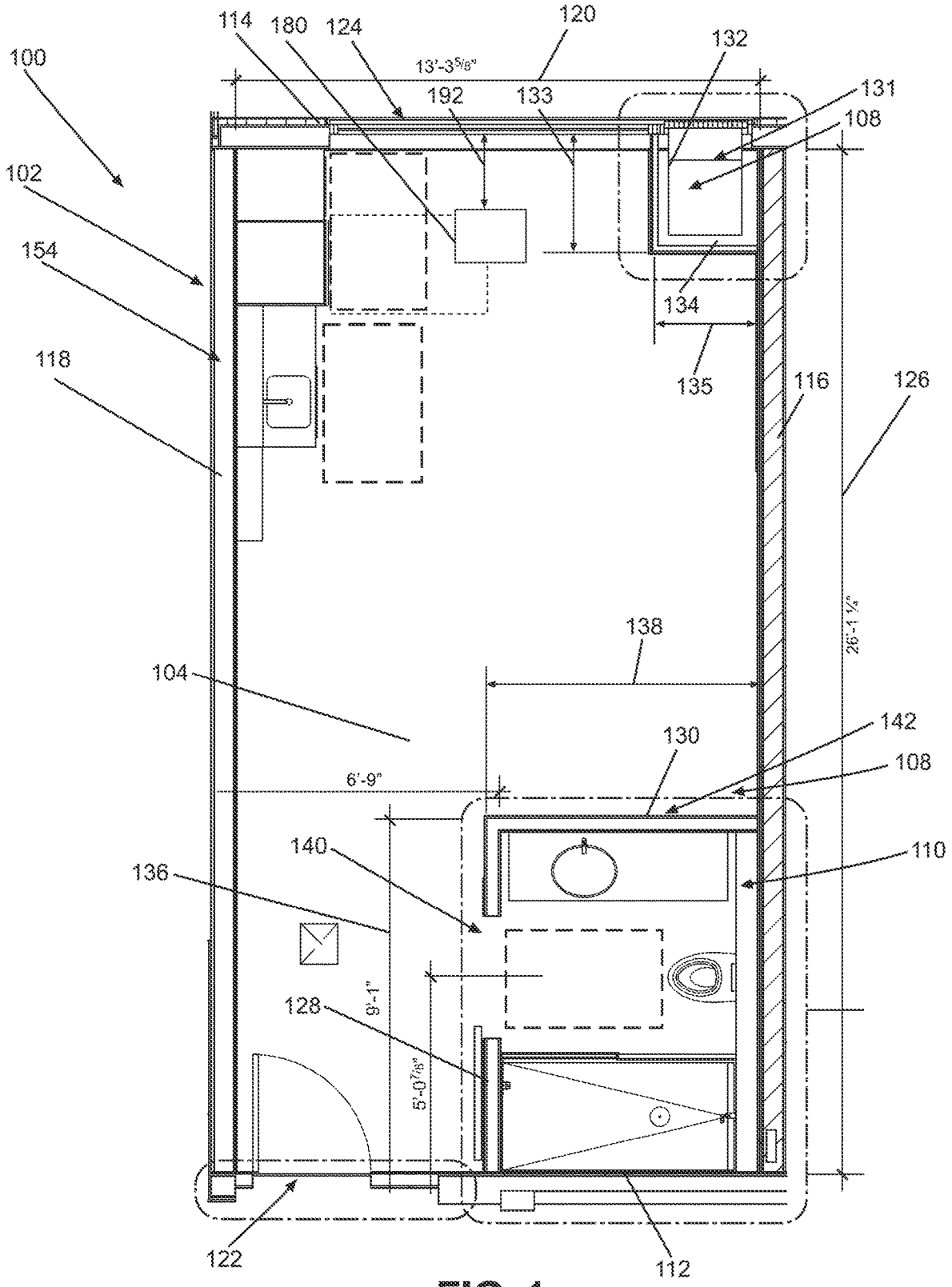
FIG. 1 illustrates a schematic floor plan of a housing unit in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, and devices may individually or collectively be components of a larger system, wherein other procedures may take precedence over or otherwise modify their application.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein a dwelling is a self-contained unit of accommodation used by one or more households as a home—such as a house, apartment, mobile home, hotel, extended stay hotel, condominium, houseboat, vehicle, or other "substantial" structure. Additionally, as used herein, self-contained means complete, or having all that is needed, in itself. An apartment is a self-contained housing unit that occupies only part of a dwelling and a dwelling may include one or more apartments that are each self-contained. A hotel room is a self-contained housing unit that occupies only part of a hotel in which an occupant occupies the hotel room for a brief period of time (typically less than a month). An extended stay hotel room is a self-contained housing unit that occupies only part of an extended stay hotel in which an occupant occupies the extended stay hotel room for an extended period of time (typically longer than a month). A full-sized kitchen includes a full-sized refrigerator, a dishwasher, a stove, a microwave oven/convection oven combination, and a sink. A full-sized refrigerator is a home appliance including a refrigeration section and a freezer section separated from each other by a thermally insulated barrier such that fluid within either the refrigeration section or the freezer section does not flow freely therebetween. Additionally, a full-size refrigerator may have a total volume of at least 8 cubic feet. An ultra-short throw mini projector is a projector that is positioned less than 1 foot away from a screen and projects an image on the screen that has a display size of at least 55 inches when measured diagonally from a first corner of the image to a second corner of the image.

This description provides dimensions of various aspects of the embodiments described herein. The provided dimensions are specific examples of measurements that may vary and are not intended to limit the scope, applicability or configuration of the embodiments described herein. Rather, the dimensions will provide those skilled in the art with an enabling description for implementing embodiments of the invention. Various changes may be made to the dimension such that the dimensions vary while the area of the housing unit described herein remains under 400 square feet.

Figure 2:
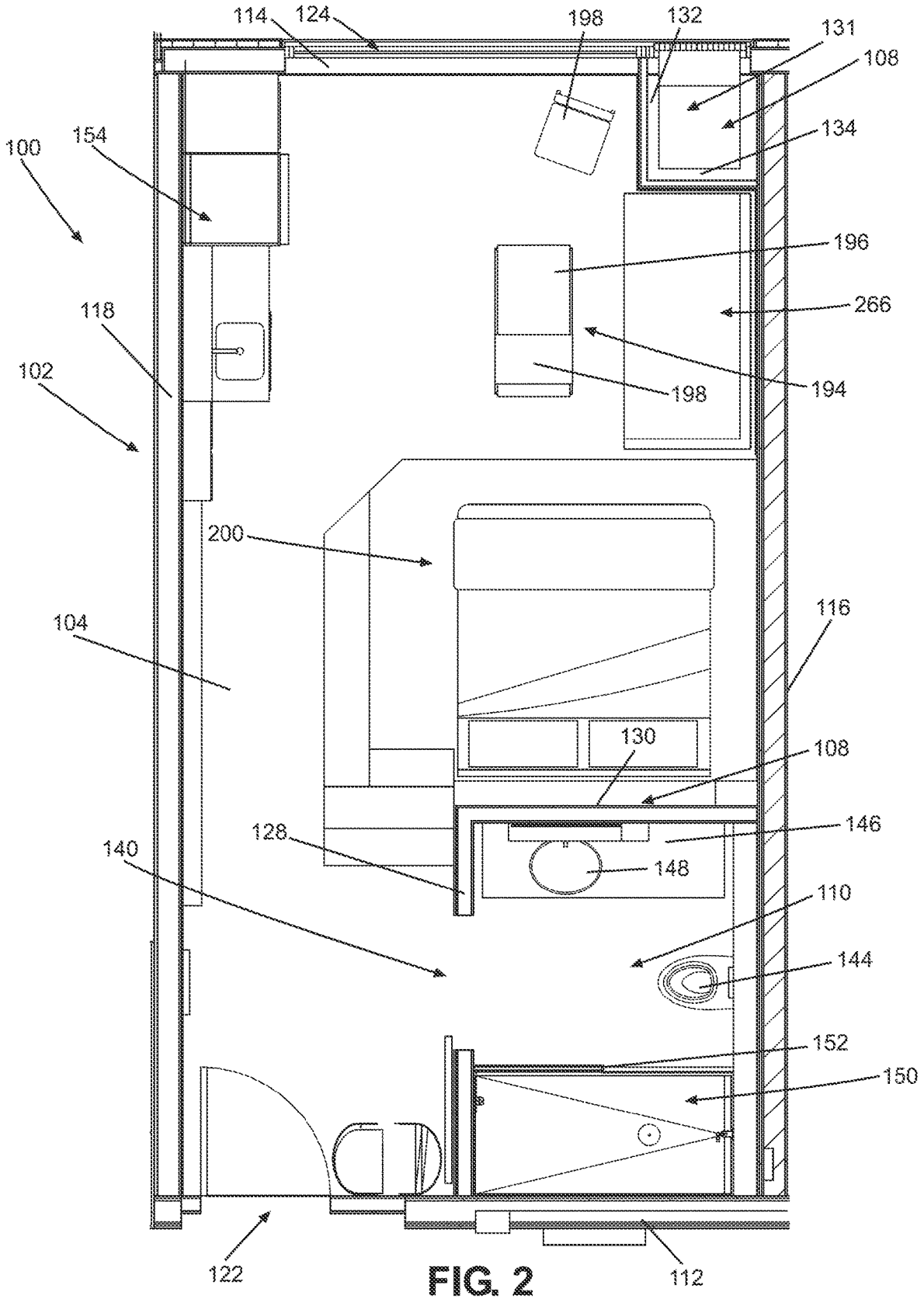
FIG. 2 illustrates a schematic furniture plan of the housing unit in accordance with the present disclosure.

FIG. 1 illustrates a schematic floor plan of a housing unit 100. FIG. 2 illustrates a schematic furniture plan of the housing unit 100. The housing unit 100 is a self-contained unit of accommodation that is a portion of a dwelling (not shown) used by one or more households as a home—such as a house, apartment, mobile home, hotel, extended stay hotel, condominium, houseboat, vehicle, or other "substantial" structure. The housing unit 100 is self-contained or complete because the housing unit 100 has all that is need for the household to function. For example, a housing unit or dwelling is self-contained when it includes a kitchen, a bedroom, a bathroom, and a living area. The housing unit 100 described herein is self-contained and has a total area of less than 400 square feet ($ft^2$), enabling a household to occupy a self-contained housing unit in a small total area and enabling apartments, hotel, condominiums, extended stay hotels, and other dwellings to include more housing units within a predetermined area. The reduced footprint of the housing unit 100 reduces housing costs for the household because the housing unit 100 occupies less total area while still providing all that the household needs. Additionally, the reduced footprint of the housing unit 100 increases profits for the builder or the dwelling owner by including more housing units 100 within the predetermined area that can be sold or rented. Accordingly, the housing units 100 described herein reduce housing costs for households and increase profits for builders or dwelling owners.

As shown in FIG. 1, the housing unit 100 includes a plurality of walls 102 that define the housing unit 100 and define an area of the housing unit 100. The walls 102 are exterior walls of the housing unit 100 that are attached to a floor 104 and a ceiling 106 (shown in FIG. 4) to completely define the housing unit 100. In the illustrated embodiment, the housing unit 100 includes four walls 102. In alternative embodiments, the housing unit 100 may include any number of walls 102 that enable the housing unit 100 to operate as described herein including, without limitation, three, five, and/or more than five walls. In some embodiments, at least some of the walls 102 are also exterior walls of the dwelling. In alternative embodiments, the walls 102 are interior walls of the dwelling. The housing unit 100 may optionally also include at least one interior wall 108 to define additional rooms within the housing unit 100. For example, in the illustrated embodiment, the housing unit 100 includes interior walls 108 that partially define a bathroom 110 within the housing unit 100.

In the illustrated embodiment, the plurality of walls 102 includes a first wall 112, a second wall 114, a third wall 116, and a fourth wall 118. The first and second walls 112 and 114 are of approximately equal length 120 and define the ends of the housing unit 100. The first wall defines a door 122 for entry and exit into and out of the housing unit 100, and the second wall 114 defines a window 124 to enable exterior light to enter the housing unit 100. The third and fourth walls 116 and 118 are of approximately equal length 126 and define the sides of the housing unit 100. The length 120 of the first and second walls 112 and 114 is about 20 feet (ft) to about 30 ft, about 23 ft to about 27 ft, about 26 ft, or about 26 ft 1.25 inches. The length 126 of the third and fourth walls 116 and 118 is about 5 ft to about 20 ft, about 10 ft to about 15 ft, about 13 ft, or about 13 ft 3.625 inches. In the illustrated embodiment, the length 126 of the third and fourth walls 116 and 118 is longer than the length 120 of the first and second walls 112 and 114 and the walls 102 are arranged at approximately right angles to each other such that the housing unit 100 has a rectangular shape. In alternative embodiments, the walls 102 may have any length and may be arranged at any angle relative to each other such that the housing unit 100 has any shape that enables the housing unit 100 to operate as described herein.

In the illustrated embodiment, the at least one interior wall 108 includes a first interior wall 128, a second interior wall 130, a third interior wall 132, and a fourth interior wall 134. The first interior wall 128 is attached to and extends from the first wall 112 and the second interior wall 130, and the second interior wall 130 is attached to and extends from the third wall 116 and the first interior wall 128. The first interior wall 128, the second interior wall 130, the first wall 112, and the third wall 116 define the bathroom 110. Specifically, the first interior wall 128, the second interior wall 130, the first wall 112, and the third wall 116 are arranged at right angles relative to each other such that the bathroom 110 has a rectangular shape. A length 136 of the first interior wall 128 is about 5 feet (ft) to about 15 ft, about 7 ft to about 10 ft, about 9 ft, or about 9 ft 1 inch. A length 138 of the second interior wall 130 is about 3 ft to about 10 ft, about 5 ft to about 7 ft, about 6 ft, or about 6 ft 6.625 inches. In alternative embodiments, the interior walls 108 may have any length and may be arranged at any angle relative to each other such that the housing unit 100 has any shape that enables the housing unit 100 to operate as described herein. The first interior wall 128 defines a door 140 for entry and exit into and out of the bathroom 110, and the second interior wall 130 defines a window 142 to enable light from the housing unit 100 and the window 124 to enter the bathroom 110.

The third interior wall 132 is attached to and extends from the second wall 114 and the fourth interior wall 134, and the fourth interior wall 134 is attached to and extends from the third wall 116 and the third interior wall 132. The third interior wall 132, the fourth interior wall 134, the second wall 114, and the third wall 116 define a utility closet 131. Specifically, the third interior wall 132, the fourth interior wall 134, the second wall 114, and the third wall 116 are arranged at right angles relative to each other such that the utility closet 131 has a rectangular or square shape. A length 133 of the third interior wall 132 is about 3 feet (ft) to about 5 ft, about 3 ft to about 4 ft, about 3 ft, or about 3 ft 2 inches. A length 135 of the fourth interior wall 134 is about 2 ft to about 4 ft, about 2 ft to about 3 ft, about 3 ft, or about 2 ft 8.25 inches. In alternative embodiments, the interior walls 108 may have any length and may be arranged at any angle relative to each other such that the housing unit 100 has any shape that enables the housing unit 100 to operate as described herein.

In the illustrated embodiment, the total area of the housing unit 100 is about 300 $ft^2$ to about 400 $ft^2$, about 320 $ft^2$ to about 360 $ft^2$, about 340 $ft^2$ to about 350 $ft^2$, or about 347.24 $ft^2$. Thus, the total area of the housing unit 100 is less than 400 $ft^2$, enabling a household to occupy a self-contained housing unit in a small total area and enabling apartments, hotel, condominiums, extended stay hotels, and other dwellings to include more housing units within a predetermined area. Additionally, the walls 102 and the at least one interior wall 108 each have a height of about 10 ft to provide an open feel to the housing unit 100. In alternative embodiments, the total area of the housing unit 100 may be any area that enables the housing unit 100 to operate as described herein.

The bathroom 110 includes a toilet 144, a vanity 146 including a sink 148, and a shower 150. The shower 150 is an enclosed shower attached to the first interior wall 128, the first wall 112, and the third wall 116. The shower includes a sliding door 152 that enables the shower 150 to be enclosed when in use. In alternative embodiments, the shower 150 may be any type of shower than enables the bathroom 110 and the housing unit 100 to operate as described herein, including, without limitation, a shower-tub combination. The vanity 146 is attached to the first interior wall 128, the second interior wall 130, and the third wall 116 and positioned opposite the shower 150 in the bathroom 110. The toilet 144 is positioned between the shower 150 and the vanity 146 proximate or attached to the third wall 116. Because the bathroom 110 includes the toilet 144, the sink 148 and the shower 150, the bathroom 110 is a full bathroom. A full bathroom is self-contained or complete because the bathroom has all that is need for the household to function.

The housing unit 100 also includes a kitchen 154 positioned along and attached to the second wall 114 and the fourth wall 118. The kitchen 154 is a full-sized kitchen because the kitchen 154 includes a full-sized refrigerator 156, a dishwasher 158, a stove 160, a microwave oven/convection oven combination 162, and a sink 164.

Figure 3:
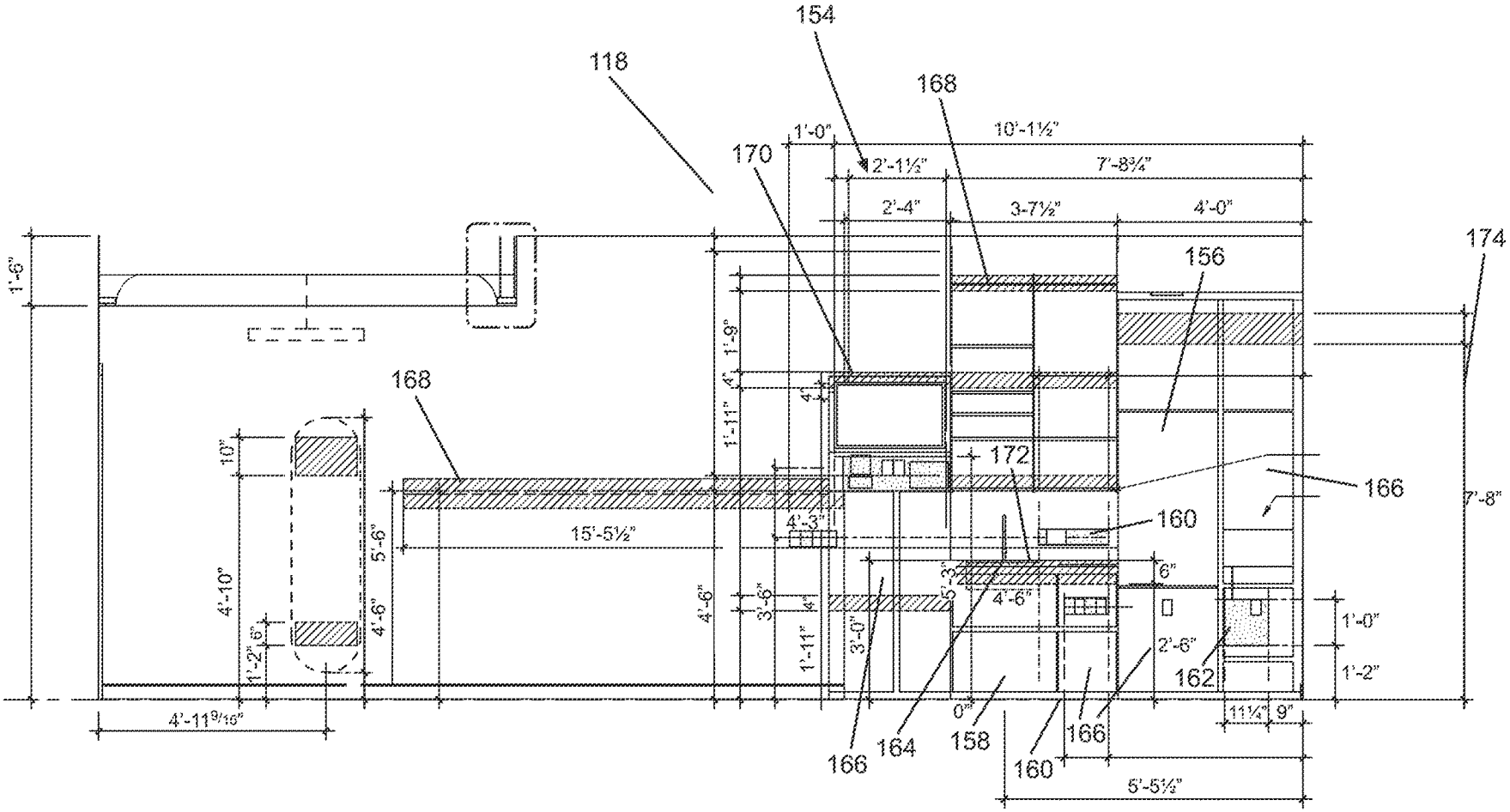
FIG. 3 illustrates an elevation view of a kitchen of the housing unit illustrated in FIGS. 1 and 2 in accordance with the present disclosure.

FIG. 3 illustrates an elevation view of the kitchen 154. As shown in FIG. 3, the kitchen 154 may also include cabinets 166, shelving 168, a television 170, and a countertop 172. The full-sized refrigerator 156 is full-sized because it includes a refrigeration section and a freezer section separated from each other by a thermally insulated barrier such that fluid within either the refrigeration section or the freezer section does not flow freely therebetween and it has a total volume of at least 10 cubic feet ($ft^3$). In the illustrated embodiment, the full-sized refrigerator 156 has a total volume of about 7 $ft^3$ to about 10 $ft^3$, or about 8 $ft^3$. In alternative embodiments, the full-sized refrigerator 156 has any total volume that enables the full-sized refrigerator 156 to operate as described herein. In the illustrated embodiment, the full-sized refrigerator 156 is clad in panels that make the full-sized refrigerator 156 look like the cabinets 166. In alternative embodiments, the full-sized refrigerator 156 may have any design that enables the full-sized refrigerator 156 and the kitchen 154 to operate as described herein.

As shown in FIG. 3, cabinets 166 are arranged in a corner of the kitchen 154 and the housing unit 100 and are attached to the second wall 114 and the fourth wall 118. The cabinets 166 have a height 174 of about 8 ft 7 inches and the full-sized refrigerator 156 and the microwave oven/convection oven combination 162 are positioned within the cabinets 166. The cabinets 166 provide storage for non-perishable kitchen items, the full-sized refrigerator 156 provides storage for perishable kitchen items, and the microwave oven/convection oven combination 162 cooks food. In alternative embodiments, the cabinets 166, the full-sized refrigerator 156, and the microwave oven/convection oven combination 162 may have any arrangement relative to each other that enables the kitchen 154 to operate as described herein.

The countertop 172 is attached to the fourth wall 118 and positioned next to the cabinets 166, the full-sized refrigerator 156, and the microwave oven/convection oven combination 162. Shelving 168 is positioned above the countertop 172 and attached to the fourth wall 118. The sink 164 and the stove 160 are positioned on the countertop 172 and the cabinets 166 are also positioned below the countertop 172. The sink 164 provides water to the kitchen 154 and the stove 160 cooks food. The dishwasher 158 cleans dishes and is positioned in the cabinets 166 below the countertop 172. The shelving 168 positioned above the countertop 172 provides storage for non-perishable kitchen items.

The television 170 is positioned next to the shelving 168 positioned above the countertop 172 and attached to the fourth wall 118. The cabinets 166 are also attached to the fourth wall 118 and positioned below the television 170. The cabinets 166 positioned below the television 170 provide storage for non-perishable kitchen items and the television 170 and the television provides entertainment. Additional shelving 168 is attached to the fourth wall 118 and positioned next to the cabinets 166 positioned below the television 170 to provide additional storage for the housing unit 100.

Figure 4:
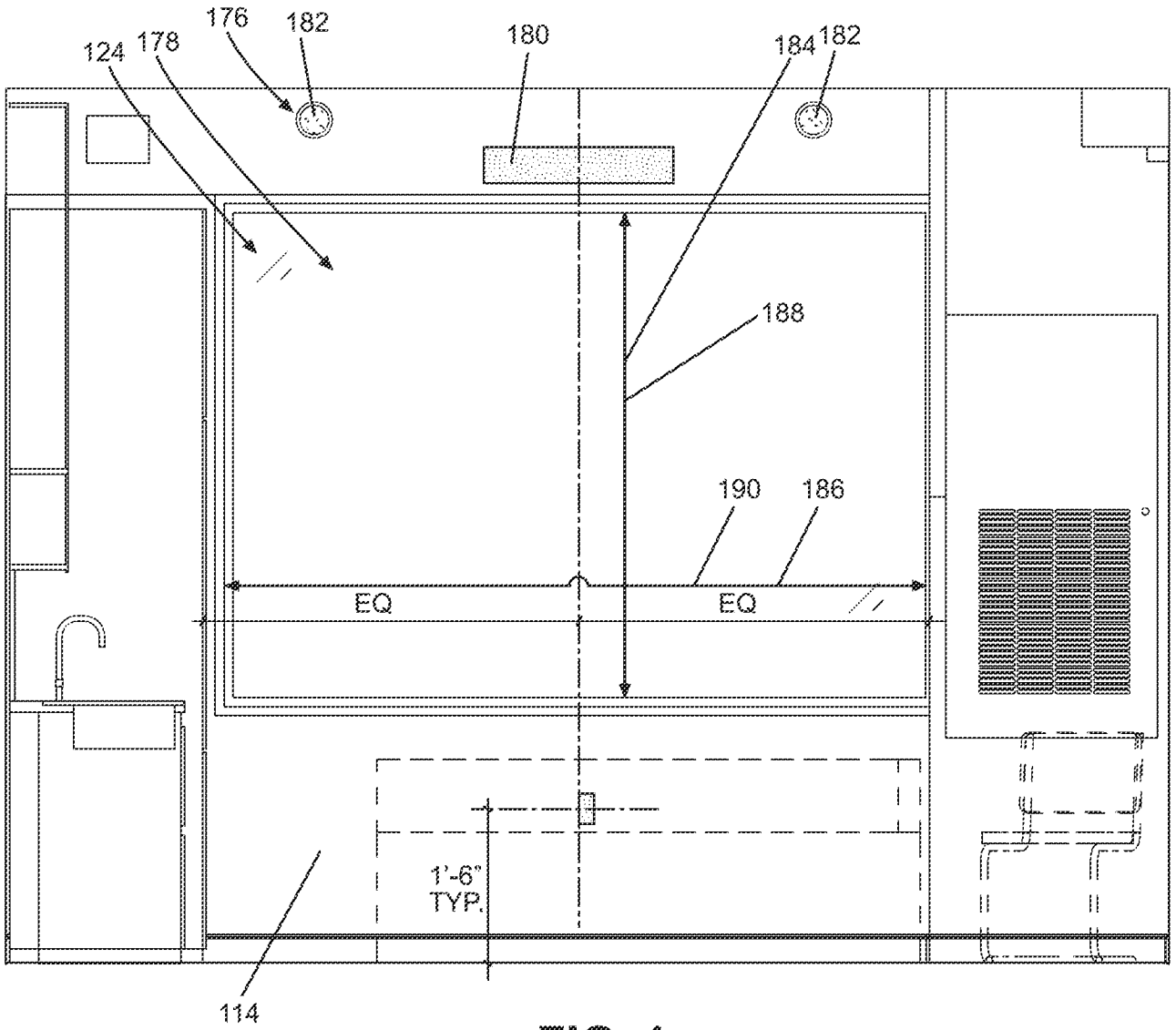
FIG. 4 illustrates an elevation view of a second wall of the housing unit illustrated in FIGS. 1 and 3 including an entertainment system in accordance with the present disclosure.

FIG. 4 illustrates an elevation view of the second wall 114 including an entertainment system 176. The entertainment system 176 includes a screen 178, a projector 180, and at least one speaker 182. The entertainment system 176 is configured to provide a large entertainment system while taking up a minimal amount of space. For example, the screen 178 is attached to the ceiling 106 and is selectively movable between a stored configuration and a deployed configuration. In the stored configuration, the screen 178 is retracted into the ceiling 106 such that the screen 178 is not visible and does not cover the window 124. For example, the screen 178 may be attached to a roller (not shown) within the ceiling 106 and the screen 178 is rolled up into the ceiling 106 by rotating the roller. In the deployed configuration, the screen 178 is unrolled and at least partially covers the window 124 to provide a large viewing area and to prevent exterior light interfering with the projector 180. In the illustrated embodiment, the window 124 has a window height 184 of about 6 ft and a window width 186 of about 4 ft. Similarly, when in the deployed configuration, the screen 178 has a screen height 188 of about 6 ft and a screen width 190 of about 4 ft to enable the screen to completely cover the window 124.

In the illustrated embodiment, the projector 180 is an ultra-short throw mini projector that is positioned less than 1 foot away from a screen and projects an image on the screen that has a display size of at least 100 inches when measured diagonally from a first corner of the image to a second corner of the image. In the illustrated embodiment, the projector 180 is positioned a projector distance 192 away from the screen 178 of about 1 ft. In alternative embodiments, the projector 180 may be positioned any distance from the screen 178 that enables the entertainment system to operate as described herein. The at least one speaker 182 is positioned within the housing unit 100 and broadcasts sound from the projector 180 into the housing unit 100. The at least one speaker 182 may be positioned at any location within the housing unit 100 that enables the speakers 182 to operate as described herein. For example, in the illustrated embodiment, the at least one speaker 182 is attached to the second wall 114 and broadcasts sound from the projector 180 into the housing unit 100.

The housing unit 100 also includes a table system 194 movably positioned within the housing unit 100. As shown in FIG. 2, the table system 194 may be positioned proximate the kitchen 154 and the entertainment system 176. In the illustrated embodiment, the table system 194 is convertible into a table 196 and at least one chair 198. The at least one chair 198 may be two or more chairs. The table system 194 folds to provide storage for the table 196 and the chairs 198 when not in use. During use, the table system 194 unfolds to free the chairs 198 and to make the table 196 larger to provide a larger surface for eat and working. Thus, the table system 194 expands and contracts to provide additional surfaces for the household as needed.

Figure 5:
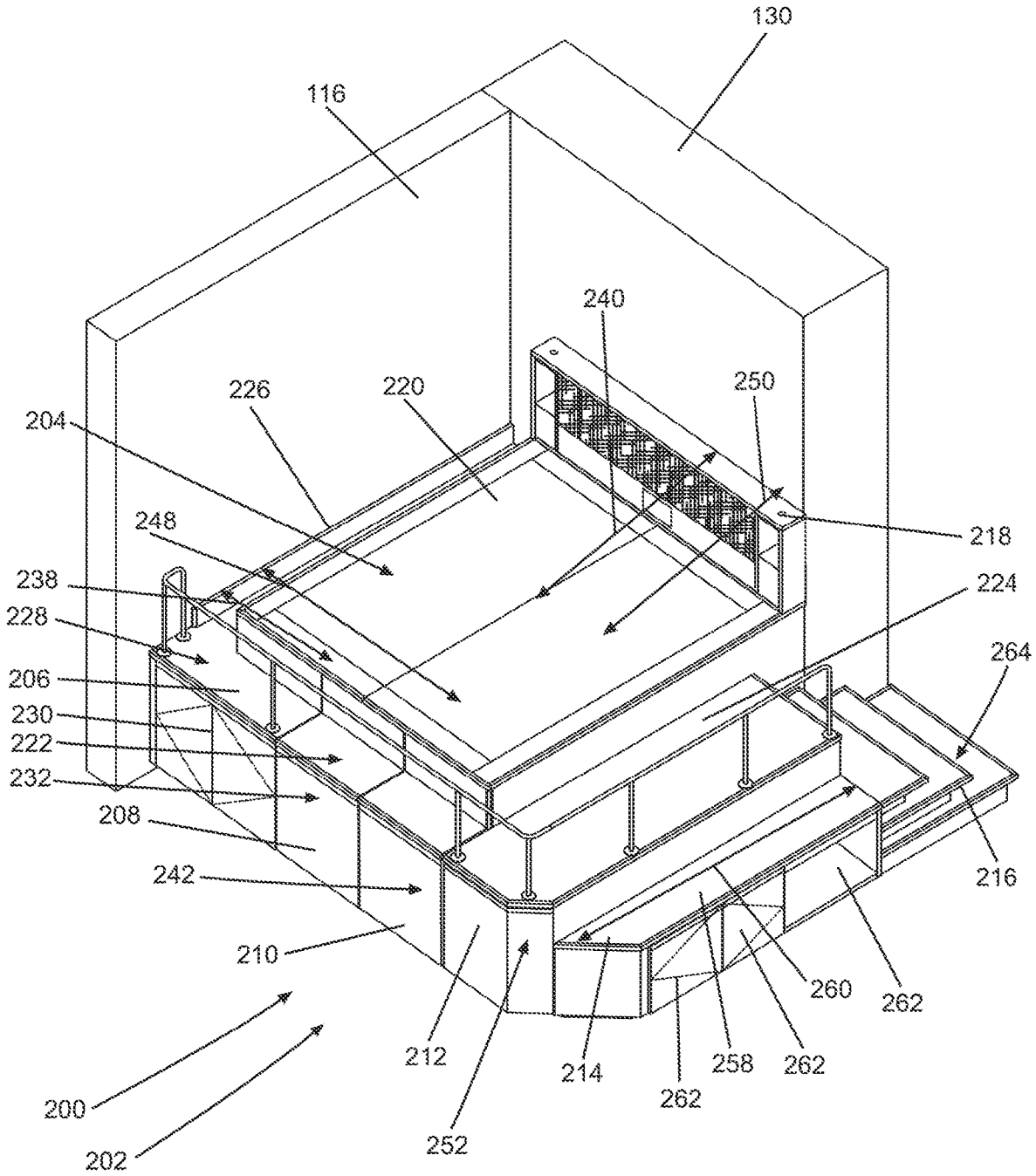
FIG. 5 is a perspective schematic view of a raised bed unit within the housing unit illustrated in FIGS. 1 and 2 in accordance with the present disclosure.
Figure 6:
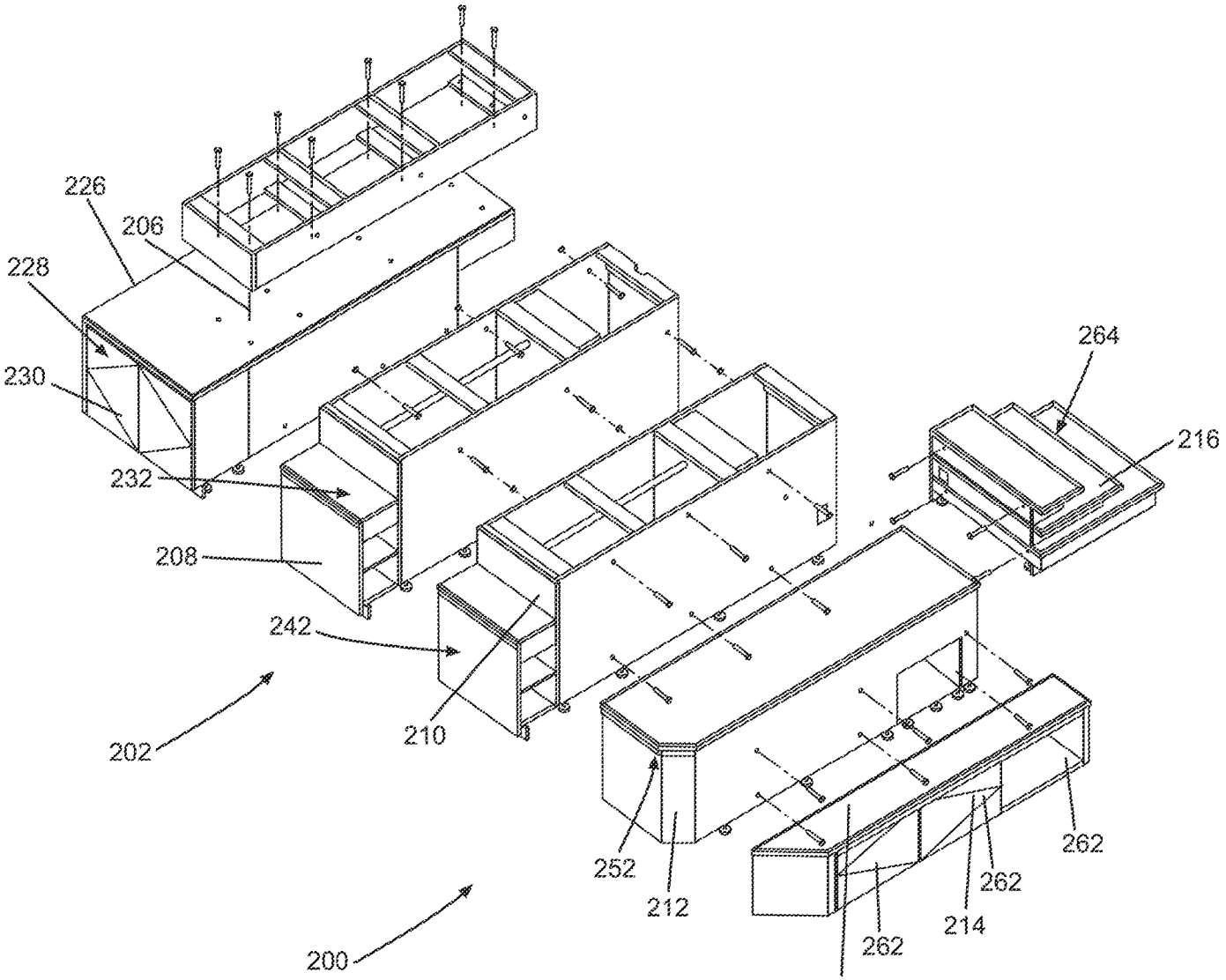
FIG. 6 is an exploded view of the raised bed unit illustrated in FIG. 5 in accordance with the present disclosure.
Figure 7:
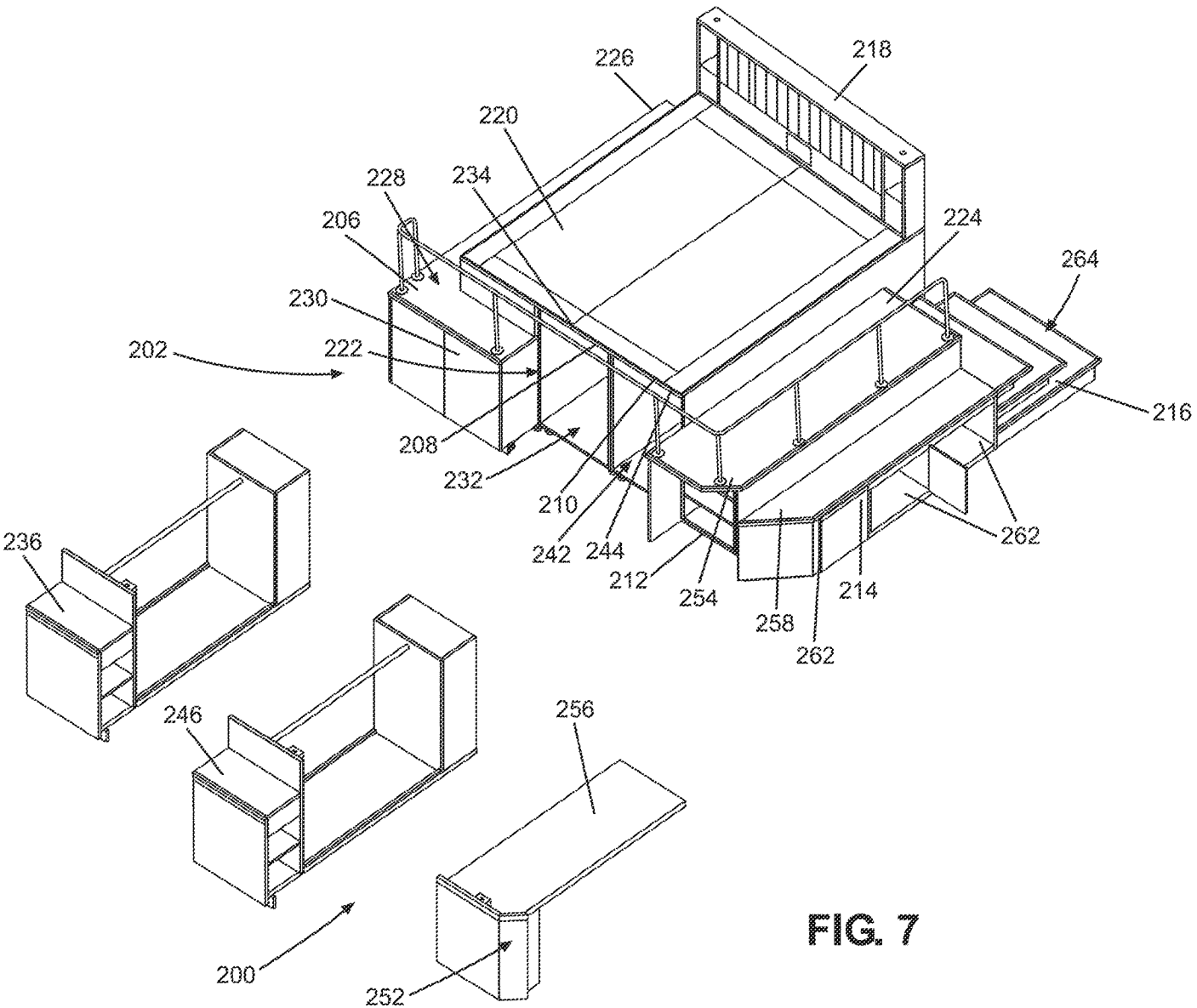
FIG. 7 is a perspective view of the raised bed unit illustrated in FIGS. 5 and 6 with portions of the raised bed unit removed in accordance with the present disclosure.

The housing unit 100 also includes a raised bed unit 200. FIG. 5 is a perspective schematic view of the raised bed unit 200. FIG. 6 is an exploded view of the raised bed unit 200. FIG. 7 is a perspective view of the raised bed unit 200 with portions of the raised bed unit 200 removed. The raised bed unit 200 includes of a plurality of modules 202 attached to each other and a first bed 204 positioned on the modules 202. The modules 202 include a storage module 206, a first closet module 208, a second closet module 210, a desk module 212, a bench module 214, a stair module 216, and a headboard 218. The modules 202 are attached to each other to form the raised bed unit 200 and to define a raised platform 220, a storage area 222 beneath the raised platform 220, and a walking path 224 around the raised platform 220. The raised platform 220 supports the first bed 204, and the storage area 222 stores components of the storage module 206, the first closet module 208, the second closet module 210, and the desk module 212 as described herein.

The storage module 206 is positioned proximate the third wall 116 and the second interior wall 130 and forms a first edge 226 of the raised bed unit 200. The storage module 206 may be attached to the third wall 116 and the second interior wall 130 for additional stability. The storage module 206 defines a storage compartment 228 at least partially within the storage area 222 beneath the raised platform 220. The storage module 206 includes at least one door 230 for access to the storage compartment 228.

The first closet module 208 is positioned proximate the storage module 206 and the second interior wall 130 and is attached to the storage module 206 and the second closet module 210 for stability. The first closet module 208 may also be attached to the second interior wall 130 for additional stability. The first closet module 208 defines a first closet 232 at least partially positioned in the storage area 222 in a stored configuration. The first closet module 208 includes a first closet shell 234 and a first movable closet platform 236 selectively movable between the stored configuration and a deployed configuration. In the stored configuration, the first movable closet platform 236 is positioned within the first closet shell 234 and the storage area 222 beneath the raised platform 220. In the deployed configuration, the first movable closet platform 236 is positioned out of the first closet shell 234 and the storage area 222. The first movable closet platform 236 does not extend the entire length of the first closet module 208, and, as such, the first closet 232 is not positioned proximate the second interior wall 130. Thus, the first closet 232 is positioned a first distance 238 from the third wall 116 and a second distance 240 from the second interior wall 130 or a distance from the walls 102 and the interior walls 108. In the illustrated embodiment, the first distance 238 is 3 ft 2 inches and the second distance 240 is 1.25 ft. In alternative embodiments, the first and second distances 238 and 240 may be any distance that enables the raised bed unit 200 to operate as described herein.

The second closet module 210 is positioned proximate the first closet module 208 and the second interior wall 130 and is attached to the first closet module 208 and the desk module 212 for stability. The second closet module 210 may also be attached to the second interior wall 130 for additional stability. The second closet module 210 defines a second closet 242 at least partially positioned in the storage area 222 in a stored configuration. The second closet module 210 includes a second closet shell 244 and a second movable closet platform 246 selectively movable between the stored configuration and a deployed configuration. In the stored configuration, the second movable closet platform 246 is positioned within the second closet shell 244 and the storage area 222 beneath the raised platform 220. In the deployed configuration, the second movable closet platform 246 is positioned out of the second closet shell 244 and the storage area 222. The second movable closet platform 246 does not extend the entire length of the second closet module 210, and, as such, the second closet 242 is not positioned proximate the second interior wall 130. Thus, the second closet 242 is positioned a third distance 248 from the third wall 116 and a fourth distance 250 from the second interior wall 130 or a distance from the walls 102 and the interior walls 108. In the illustrated embodiment, the third distance 248 is 5 ft 1.25 inches and the fourth distance 250 is 1.25 ft. In alternative embodiments, the third and fourth distances 248 and 250 may be any distance that enables the raised bed unit 200 to operate as described herein.

The desk module 212 is positioned proximate the second closet module 210 and is attached to the second closet module 210 and the bench module 214 for stability. The desk module 212 defines a desk 252 at least partially positioned in the storage area 222 in a stored configuration. The desk module 212 includes a desk shell 254 and a movable desk 256 selectively movable between the stored configuration and a deployed configuration. In the stored configuration, the movable desk 256 is positioned within the desk shell 254 and the storage area 222 beneath the raised platform 220. In the deployed configuration, the movable desk 256 is positioned out of the desk shell 254 and the storage area 222.

The bench module 214 is positioned proximate the desk module 212 and the stair module 216 and is attached to the desk module 212 and the stair module 216 for stability. The bench module 214 defines a bench 258 extending along a length 260 of the bench module 214 and at least one cabinet 262 positioned beneath the bench 258. In the illustrated embodiment, the at least one cabinet 262 includes three cabinets 262 positioned beneath the bench 258. In alternative embodiments, the bench module 214 may include any number of cabinets 262 that enable the bench module 214 to operate as described herein. The stair module 216 it positioned proximate the desk module 212 and the bench module 214 and is attached to the desk module 212 and the bench module 214 for stability. The stair module 216 defines a plurality of stairs 264 that provide access to the walking path 224. The headboard 218 is positioned on the raised platform 220 proximate the second interior wall 130 and is attached to the raised platform 220 for stability. The headboard 218 may also be attached to the second interior wall 130 for additional stability. The headboard 218 may include electrical outlets (not shown) and lights (not shown). The window 142 is positioned above the headboard 218 of the raised bed unit 200.

Figure 8:
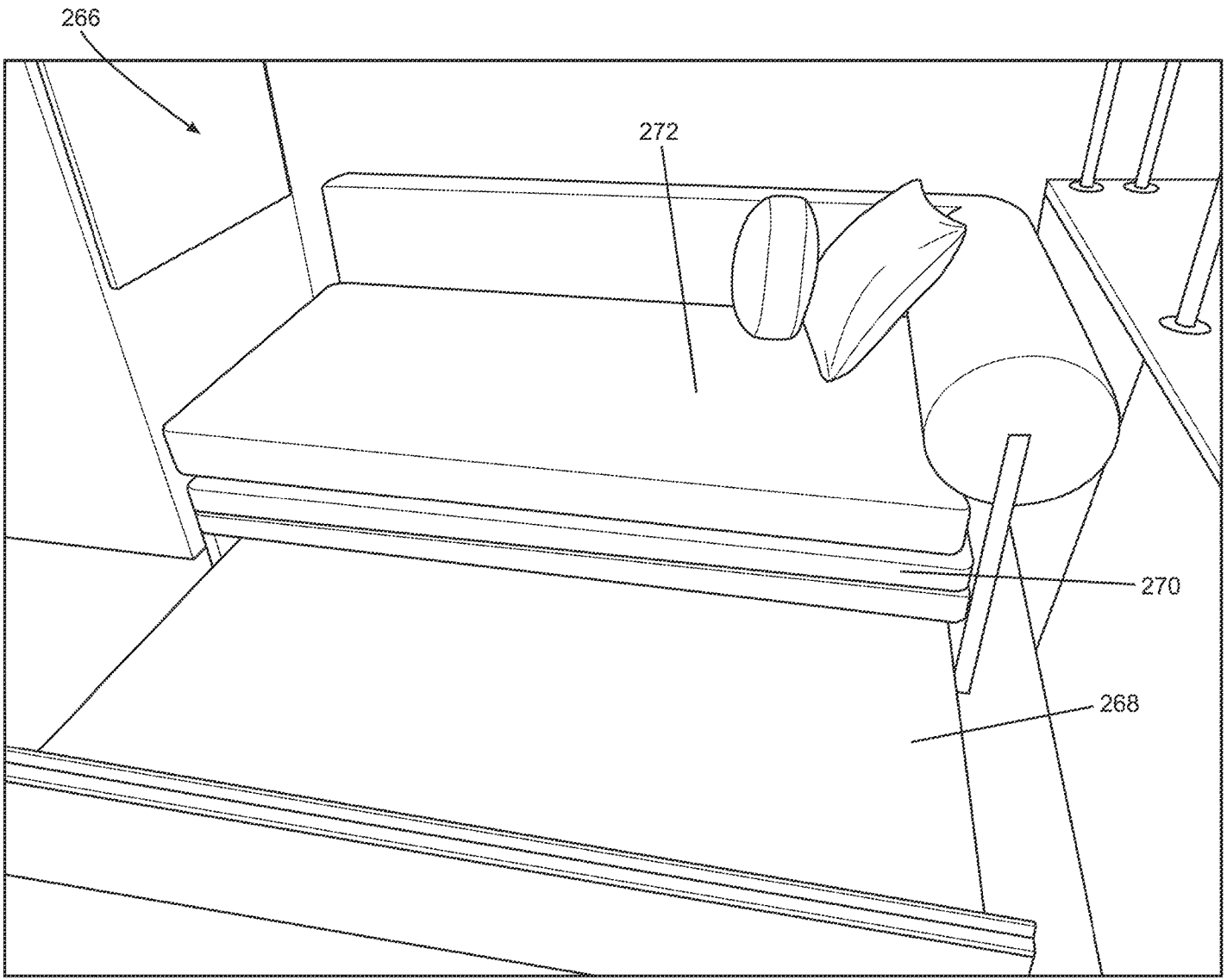
FIG. 8 is a perspective view of a couch within the housing unit illustrated in FIGS. 1 and 2 in the couch configuration in accordance with the present disclosure.
Figure 9:
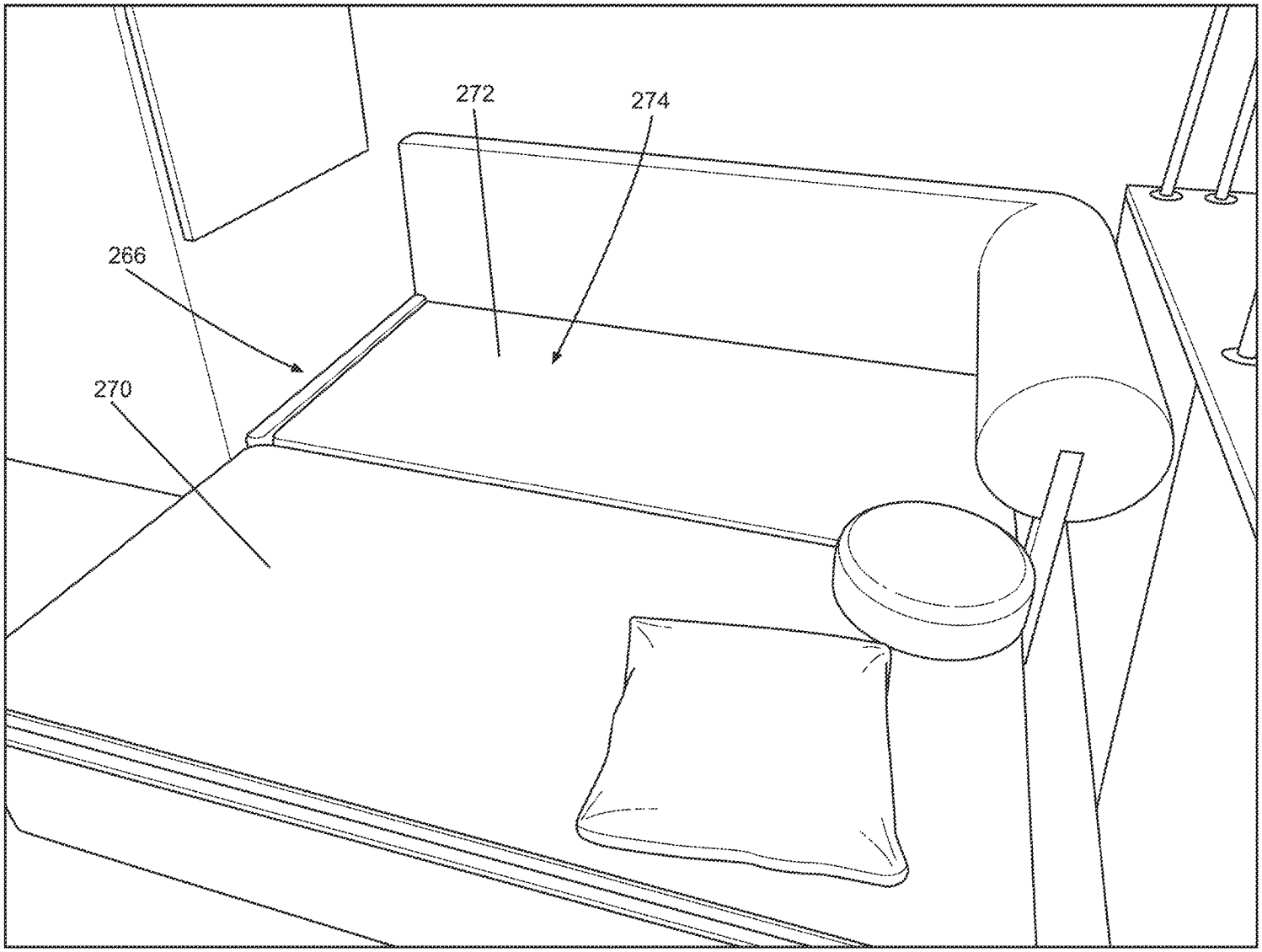
FIG. 9 is a perspective view of the couch illustrated in FIG. 8 in the bed configuration in accordance with the present disclosure.

The housing unit 100 also includes a couch 266 movably positioned proximate the third wall 216 and the raised bed unit 200. Specifically, the couch 266 is sized and shaped to be positioned in front of the doors 230 of the storage module 206. The couch 266 is moved away from the doors 230 to access the storage compartment 228. Additionally, the couch 266 is convertible between a couch configuration and a bed configuration. FIG. 8 is a perspective view of the couch 266 in the couch configuration with a trundle drawer 268 pulled out and FIG. 9 is a perspective view of the couch 266 in the bed configuration. As shown in FIGS. 8 and 9, the couch includes the trundle drawer 268, a first cushion 270, and a second cushion 272 positioned on top of the first cushion 270 in the couch configuration. The couch 266 is converted into the bed configuration by pulling out the trundle drawer 268 and repositioning the second cushion 272 from on top of the first cushion 270 to within the trundle drawer 268 next to the first cushion 270. The first cushion 270 and the second cushion 272 form a second bed 274 when the couch 266 is reconfigured in the bed configuration. In the illustrated embodiment, the second bed 274 is a queen-sized bed. In alternative embodiments, the second bed 274 may be any size that enables the couch 266 to operate as described herein.

Figure 10:
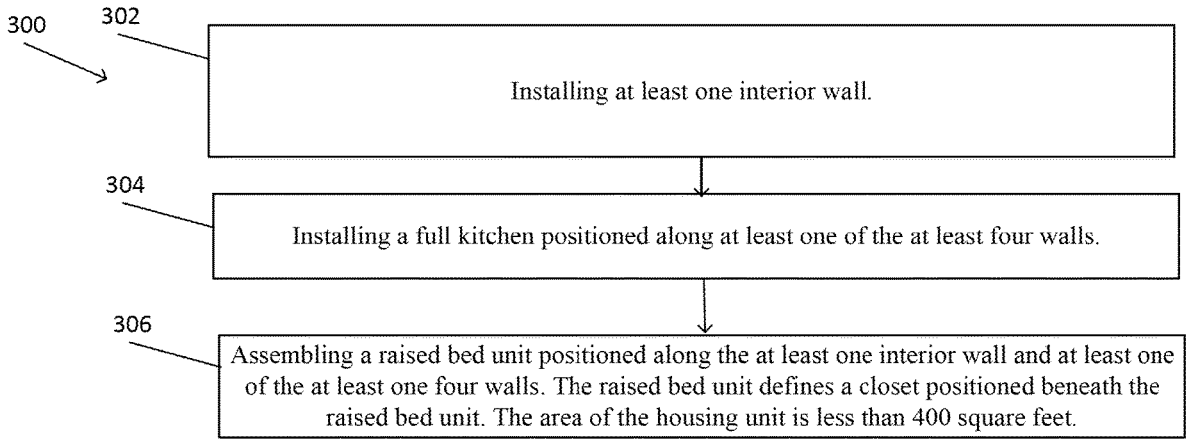
FIG. 10 is a flow diagram of a method of furnishing a housing unit in accordance with the present disclosure.

FIG. 10 is a flow diagram of a method 300 of furnishing a housing unit. The housing unit is defined by at least four walls that define an area of the housing unit. The method 300 includes installing 302 at least one interior wall. The method 300 also includes installing 304 a full kitchen positioned along at least one of the at least four walls. The method 300 further includes assembling 306 a raised bed unit positioned along the at least one interior wall and at least one of the at least one four walls. The raised bed unit defines a closet positioned beneath the raised bed unit. The area of the housing unit is less than 400 square feet. The raised bed unit may include a plurality of modules and assembling the raised bed may include assembling the plurality of modules. The plurality of modules may include a closet module including a closet shell and a movable closet platform, and the movable closet platform may be selectively movable between a stored configuration and a deployed configuration. The plurality of modules may include a desk module including a desk shell and a movable desk, and the movable desk may be selectively movable between a stored configuration and a deployed configuration.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A dwelling comprising:

at least four walls defining a housing unit and an area of the housing unit, the housing unit comprising:

at least one interior wall, wherein at least one of the at least four walls and the at least one interior wall define a bathroom;

a full-sized kitchen positioned along at least one of the four walls;

a first closet positioned a distance from the four walls and the interior wall, wherein the first closet includes a closet rod configured to hang clothes, one or more shelves, a closet shell, and a movable closet platform, and wherein the movable closet platform is selectively movable between a stored configuration and a deployed configuration relative to the closet shell; and a raised bed unit comprising a raised platform and a first bed positioned on the raised platform, the raised platform defining a storage area beneath the first bed, wherein the first closet is positioned at least partially within the storage area, and wherein the area of the housing unit is less than 400 square feet.

2. The dwelling of claim 1, further comprising a desk at least partially positioned within the storage area.

3. The dwelling of claim 1, wherein the housing unit further comprises a second closet at least partially positioned within the storage area.

4. The dwelling of claim 1, wherein the raised platform unit defines a walking path routed around the first bed, wherein the walking path is at least partially positioned between the first bed and at least three of the four walls.

5. The dwelling of claim 1, wherein the full-sized kitchen comprises a full-sized refrigerator, a dishwasher, a stove, and a sink.

6. The dwelling of claim 1, wherein the housing unit further comprises a couch that converts into a second bed.

7. The dwelling of claim 6, wherein the couch includes a trundle drawer, a first cushion, and a second cushion positioned on top of the first cushion in a couch configuration, and wherein the couch is converted into a bed configuration by pulling out the trundle drawer and repositioning the second cushion from on top of the first cushion to within the trundle drawer next to the first cushion, and wherein the first cushion and the second cushion form the second bed, and wherein the second bed is a queen-sized bed.

8. The dwelling of claim 1, wherein the at least four walls and the at least one interior wall have a wall height of at least 10 feet.

9. The dwelling of claim 1, wherein at least one of the at least four walls includes at least one window having a window height of about 6 ft and a window width of about 4 ft.

10. The dwelling of claim 9, wherein the housing unit further comprises an entertainment system including a screen and an ultra-short throw mini projector.

11. The dwelling of claim 10, further comprising a ceiling attached to the at least four walls and the at least one interior wall, and wherein the projector and the screen are attached to the ceiling, wherein the screen is selectively movable between a stored configuration and a deployed configuration, and wherein the screen at least partially covers the window in the deployed configuration.

12. The dwelling of claim 1, wherein the dwelling is a hotel and the housing unit is a hotel room.

13. The dwelling of claim 1, wherein the dwelling is an apartment building and the housing unit is an apartment of the apartment building.

14. The dwelling of claim 1, wherein the dwelling is an extended stay hotel and the housing unit is an extended stay hotel room.

15. The dwelling of claim 1, the raised bed unit further comprising:

a stair module, wherein the stair module provides access to the raised platform; and a bench module, wherein the bench module is attached to the stair module.

16. A method of furnishing a housing unit, the housing unit defined by at least four walls that define an area of the housing unit, the method comprising:

installing at least one interior wall, wherein at least one of the at least four walls and the at least one interior wall define a bathroom;

installing a full kitchen positioned along at least one of the at least four walls; and assembling a raised bed unit positioned along the at least one interior wall and at least one of the at least one four walls, wherein the raised bed unit defines a closet positioned beneath the raised bed unit, wherein the closet includes a closet rod configured to hang clothes, one or more shelves, a closet shell, and a movable closet platform, wherein the movable closet platform is selectively movable between a stored configuration and a deployed configuration relative to the closet shell; and wherein the area of the housing unit is less than 400 square feet.

17. The method of claim 16, wherein the raised bed unit comprises a plurality of modules, and wherein assembling the raised bed comprises assembling the plurality of modules.

18. The method of claim 17, wherein the plurality of modules comprises a desk module comprising a desk shell and a movable desk, and wherein the movable desk is selectively movable between a stored configuration and a deployed configuration.

19. A dwelling comprising:

at least four walls defining a housing unit defining an area of the housing unit, the housing unit comprising:

at least one interior wall, wherein at least one of the at least four walls and the at least one interior wall define a bathroom;

a full-sized kitchen positioned along at least one the four walls;

a raised bed unit comprising a raised platform and a bed positioned on the raised platform unit, the raised platform unit defining a storage area beneath the bed;

a first closet positioned at least partially within the storage area, wherein the first closet includes a closet rod configured to hang clothes, one or more shelves, a first closet shell, and a first movable closet platform, and wherein the first movable closet platform is selectively movable between a stored configuration and a deployed configuration relative to the closet shell;

a second closet positioned at least partially within the storage area, wherein the second closet includes a second closet shell and a second movable closet platform, and wherein the second movable closet platform is selectively movable between the stored configuration and the deployed configuration; and a desk positioned at least partially within the storage area, wherein the area of the housing unit is less than 400 square feet.

* * * * *